US008128305B2

(12) United States Patent
Gilbert

(10) Patent No.: US 8,128,305 B2
(45) Date of Patent: Mar. 6, 2012

(54) DEVICE AND METHOD FOR ALIGNING AND SECURING A RING BINDER MECHANISM

(76) Inventor: Christopher Franz Gilbert, Falmouth, ME (US)

( * ) Notice: Subject to any disclaimer, the term of this patent is extended or adjusted under 35 U.S.C. 154(b) by 220 days.

(21) Appl. No.: 12/456,359

(22) Filed: Jun. 16, 2009

(65) Prior Publication Data

US 2010/0316435 A1 Dec. 16, 2010

(51) Int. Cl.

| | |
|---|---|
| ***B42D 1/00*** | (2006.01) |
| ***B42F 13/20*** | (2006.01) |
| ***B42F 3/00*** | (2006.01) |
| ***B42F 13/40*** | (2006.01) |
| ***B42F 3/02*** | (2006.01) |
| ***B42F 13/02*** | (2006.01) |
| ***B42F 13/30*** | (2006.01) |
| ***B42F 13/36*** | (2006.01) |

(52) U.S. Cl. ..... 402/31; 281/27.1; 402/5; 402/20; 402/26; 402/29; 402/46; 402/68; 402/73

(58) Field of Classification Search ..... 281/27.1; 402/5, 20, 26, 29, 31, 46, 68, 80 R, 73
See application file for complete search history.

(56) References Cited

U.S. PATENT DOCUMENTS

| | | | | | |
|---|---|---|---|---|---|
| 805,575 | A * | 11/1905 | Morden | ..... | 402/68 |
| 2,363,848 | A * | 11/1944 | Emmer | ..... | 402/20 |
| 3,263,687 | A | 8/1966 | Weichert | | |
| 4,552,478 | A | 11/1985 | Cohen | | |
| 5,971,649 | A | 10/1999 | To | | |
| 6,027,275 | A * | 2/2000 | Williams | ..... | 402/68 |
| 6,328,497 | B1 * | 12/2001 | To | ..... | 402/26 |
| 6,758,621 | B2 | 7/2004 | To | | |
| 2005/0163557 | A1 * | 7/2005 | England | ..... | 402/73 |

* cited by examiner

*Primary Examiner* — Dana Ross
*Assistant Examiner* — Justin Lewis
(74) *Attorney, Agent, or Firm* — Neil Y. Gilbert

(57) ABSTRACT

A ring binder mechanism having at least one pair of half-ring members that are movable between a first position, wherein the half-ring members are closed, and a second position, wherein the half-ring members are open, and at least one generally tubular member to facilitate alignment and securement of the at least one pair of half ring members when moved from the second, open position to the first, closed position.

11 Claims, 9 Drawing Sheets

DEVICE AND METHOD FOR ALIGNING AND SECURING A RING BINDER MECHANISM

CROSS REFERENCE

None

BACKGROUND OF THE INVENTION

1. Field of the Invention

The present invention relates to a device and method for aligning and securing a ring binder mechanism which is secured to a base member, such as the spine of a notebook, to form a storage device for storing loose-leaf pages, such as the commonly known three-ring binder.

2. Description of the Prior Art

Conventional ring binder mechanisms are generally constructed of a substantially rigid, elongated upper member or housing supporting a pair of plates mounted for pivotal movement within the housing with each plate carrying a plurality of half-rings, commonly three. Each half-ring on one plate is aligned with a similar half-ring on the other plate so that in a closed position the half-rings form a closure, generally circular or D-shaped in configuration, for holding a plurality of loose-leaf pages within a binder or base member to which the ring binder mechanism is secured. Commonly, the half-rings in conventional ring binders extend up through openings or slots formed in the binder upper member or housing such that loose-leaf pages mounted to the half rings through holes adjacent the pages' edges rest on the upper surface of the housing, as is shown for example in U.S. Pat. No. 5,971,649. In addition, some conventional ring binder mechanisms have their half-rings mounted so as to extend around the lateral edges of the housing and outward a sufficient distance such that the loose-leaf pages rest on a relatively horizontal portion of the half-rings and the edges of the paper do not touch the housing, as is shown for example in U.S. Pat. Nos. 3,263,687 and 4,552,478. It is also common to use such ring binder mechanisms either attached to the spine of the cover or base member or attached to one side of the cover or base member. See also U.S. Pat. No. 6,758,621, portions of the contents of which were used to describe the present invention, e.g. prior art FIGS. 1-6. U.S. Pat. No. 6,758,621 is incorporated herein by reference.

It is not uncommon for the distal (free) ends of respective pairs of ring members to become misaligned or otherwise spaced apart when in the closed position. This can result in poor securement of papers, i.e. they can fall out, become partially dislodged or become pinched or torn, particularly when moved from one portion of the ring to another.

SUMMARY OF THE INVENTION

The present invention provides a device and method for aligning and securing rings of a ring binder mechanism. In a particular embodiment, a ring binder mechanism has: at least one pair of half-ring members that are movable between a first position, wherein the half-ring members are closed, and a second position, wherein the half-ring members are open; and at least one generally tubular member to facilitate alignment and securement of the at least one pair of half ring members upon movement from the second (open) position to the first (closed) position.

In one embodiment, the tubular member can be polymeric material, such as vinyl, polyethylene or polypropylene. The tubular member can also be manufactured from thermoplastic materials, such as polyolefins, fluoropolymers, polyvinyl chloride, neoprene, or silicone elastomer. In one embodiment, the tubular member can be vinyl tubing alone or in combination with shrink tubing to aid in securing the vinyl tubing to the distal end of one of the ring member pairs.

In operation, the tubing will have a first end secured to a the distal end of a first ring member of a ring member pair and a second, free end that extends past the first end of the ring member pair. The second, free end of the tubing is configured and dimensioned to receive the distal end of the second ring member when the ring members are moved from an open position to a closed position. When closed, the distal ends of both ring members will be disposed at least partially within the tubing, thereby reducing the likelihood that the ring member ends will become misaligned. Also, because there is a length of tubing present, a gap between the ring members (if present when closed), will be covered by the tubing, thereby reducing the likelihood that paper can inadvertently pass through the gap.

DETAILED DESCRIPTION OF THE PREFERRED EMBODIMENTS

FIGS. 1-6 depict prior art ring binder mechanisms for which the present invention can be used. It is noted that the present invention can be used with other ring binder mechanisms and the embodiments in FIGS. 1-6 are provided as examples only.

Figure 1:
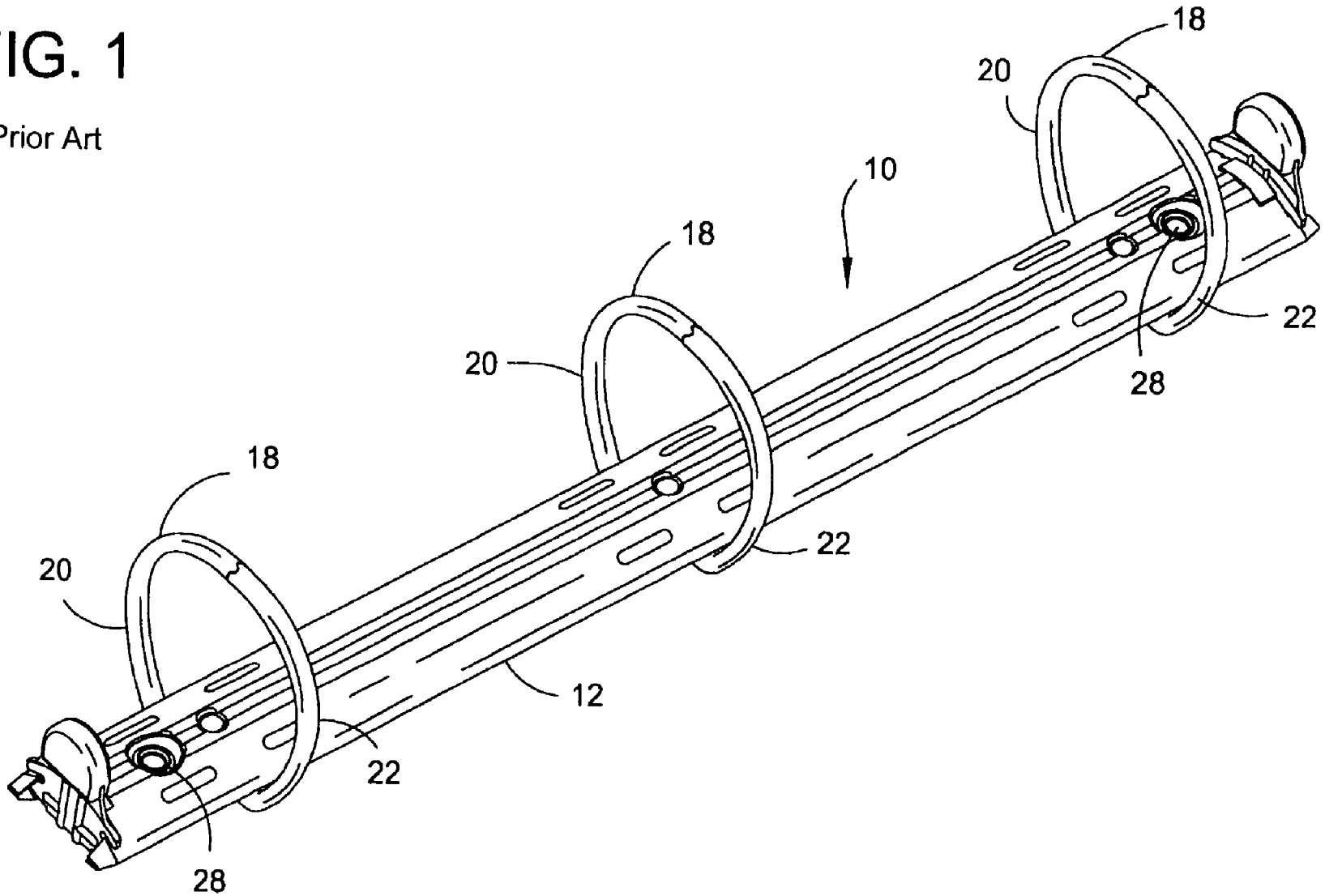
FIG. 1 Prior Art
FIG. 1 is a perspective view showing a prior art ring binder mechanism with the rings in a closed position.
Figure 2:
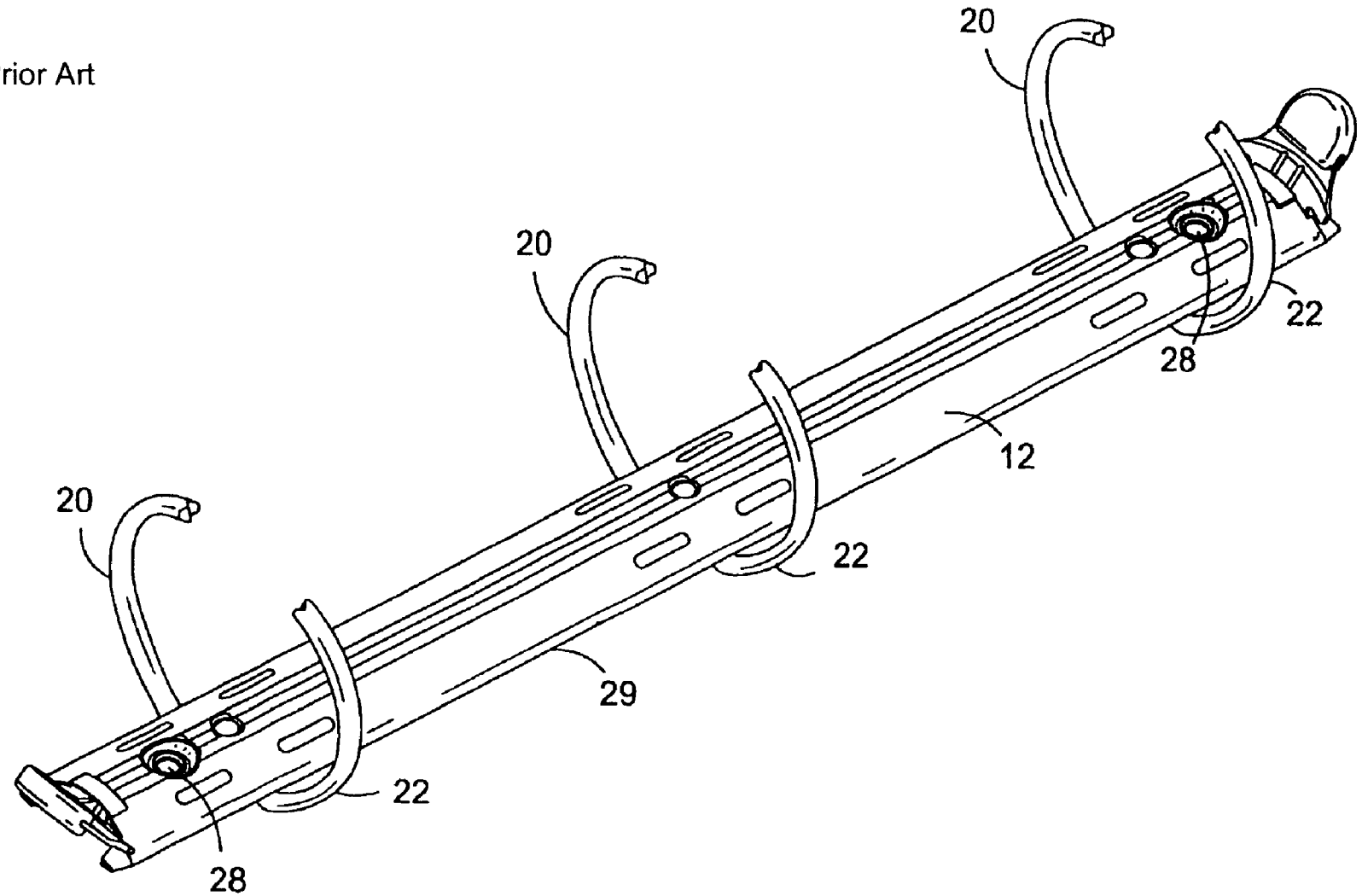
FIG. 2 Prior Art
FIG. 2 is a view similar to FIG. 1 with the rings in an open position.
Figure 4:
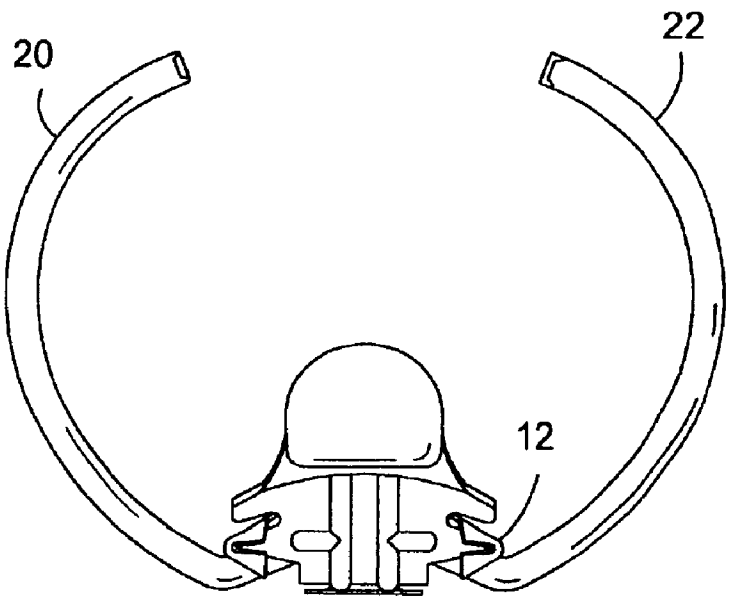
FIG. 4 Prior Art
FIG. 4 is an end view FIG. 1 with the rings in the open position.

Turning to the prior art figures, FIG. 1 shows ring binder mechanism 10 that includes a substantially rigid upper plate member 12 supporting a pair of pivitoble lower plates (not shown) that enable the rings 18 to be manually opened or closed in a conventional manner. Each pair of rings 18 is comprised of two half-ring members 20 and 22. Ring binder mechanism 10 is generally secured to a base member or cover such as by use of rivets 28 or similar structures in a conventional manner.

Figure 3:
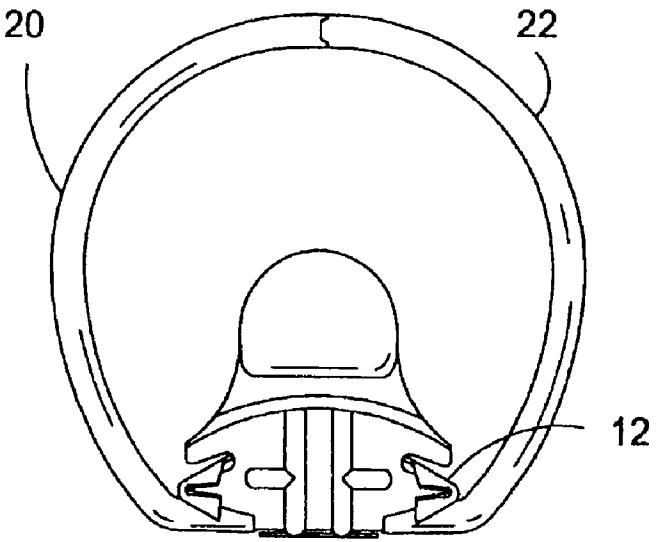
FIG. 3 Prior Art
FIG. 3 is an end view of FIG. 1 with the rings in the closed position.

When closed, half-ring members 20 and 22 form rings 18 which are generally circular in appearance as seen in FIGS. 1 and 3. By applying a separating force, rings 18 can be opened, as seen if FIG. 4. An opposite, closing force can move the half-rings back together.

Figure 6:
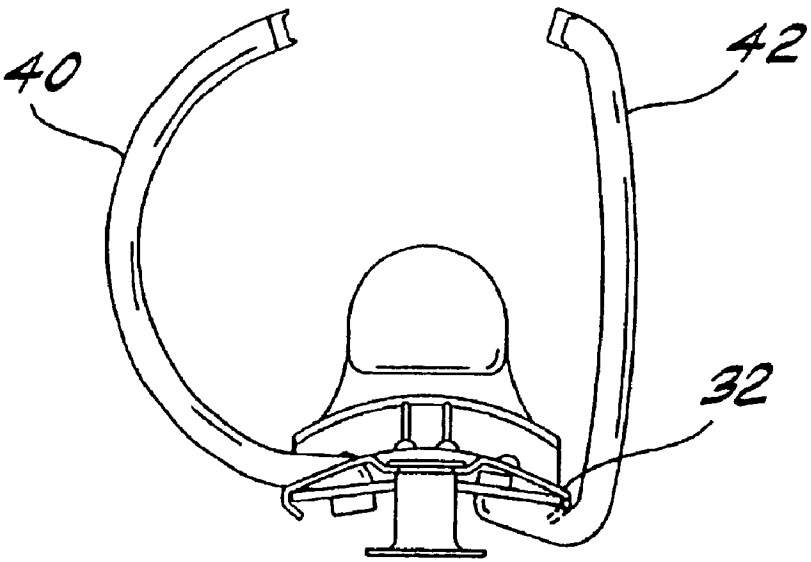
FIG. 6 Prior Art
FIG. 6 is an end view similar to FIG. 5 with the rings in the open position.
Figure 5:
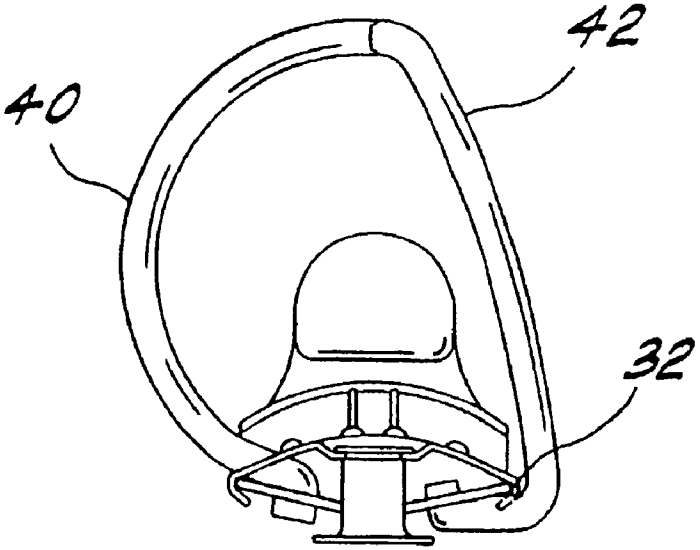
FIG. 5 Prior Art
FIG. 5 is an end view of rings in the closed position showing a different type of ring configuration.

Referring now to an alternate embodiment of the prior art, as seen in FIGS. 5 and 6, upper plate member 32 is of substantially rigid construction and has two half-ring members 40 and 42. Half-ring members 40 and 42 are similar to half-ring members 20 and 22. The main difference in this second embodiment from the first embodiment is the shape of the half-ring members 40 and 42 in that in the closed position, as shown in FIG. 5, the rings 38 are of a generally D-shaped configuration wherein half-ring member 42 is of a generally J-shaped configuration and half-ring member 40 is generally semi-circular or arcuate. Opening or closing forces move the half-ring members between the open (FIG. 6) and closed (FIG. 5) position. Other shapes and configurations known in the art can be used to from the half-ring members.

As previously indicated, an issue with these prior art ring binder mechanisms is that the distal ends of the rings (e.g. where the two half-rings meet) can become misaligned and/or partially separated when closed. The present invention, shown in the exemplary embodiments in FIGS. 7-13, provide a means to reduce the likelihood of such misalignment and/or bridge the gap if separated when closed.

Figure 7A:
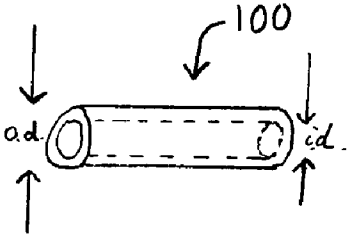
FIG. 7A shows an embodiment of a tubular member suitable for use in accordance with the present invention.
Figure 7B:
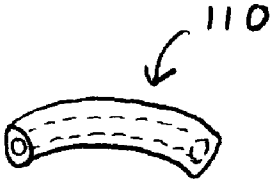
FIG. 7B shows an alternate embodiment of a tubular member suitable for use in accordance with the present invention.
Figure 7C:
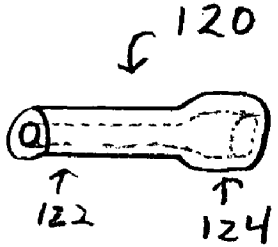
FIG. 7C shows an alternate embodiment of a tubular member suitable for use in accordance with the present invention.
Figure 7D:
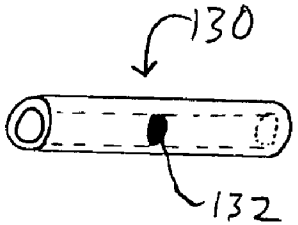
FIG. 7D shows an alternate embodiment of a tubular member suitable for use in accordance with the present invention.
Figure 8:
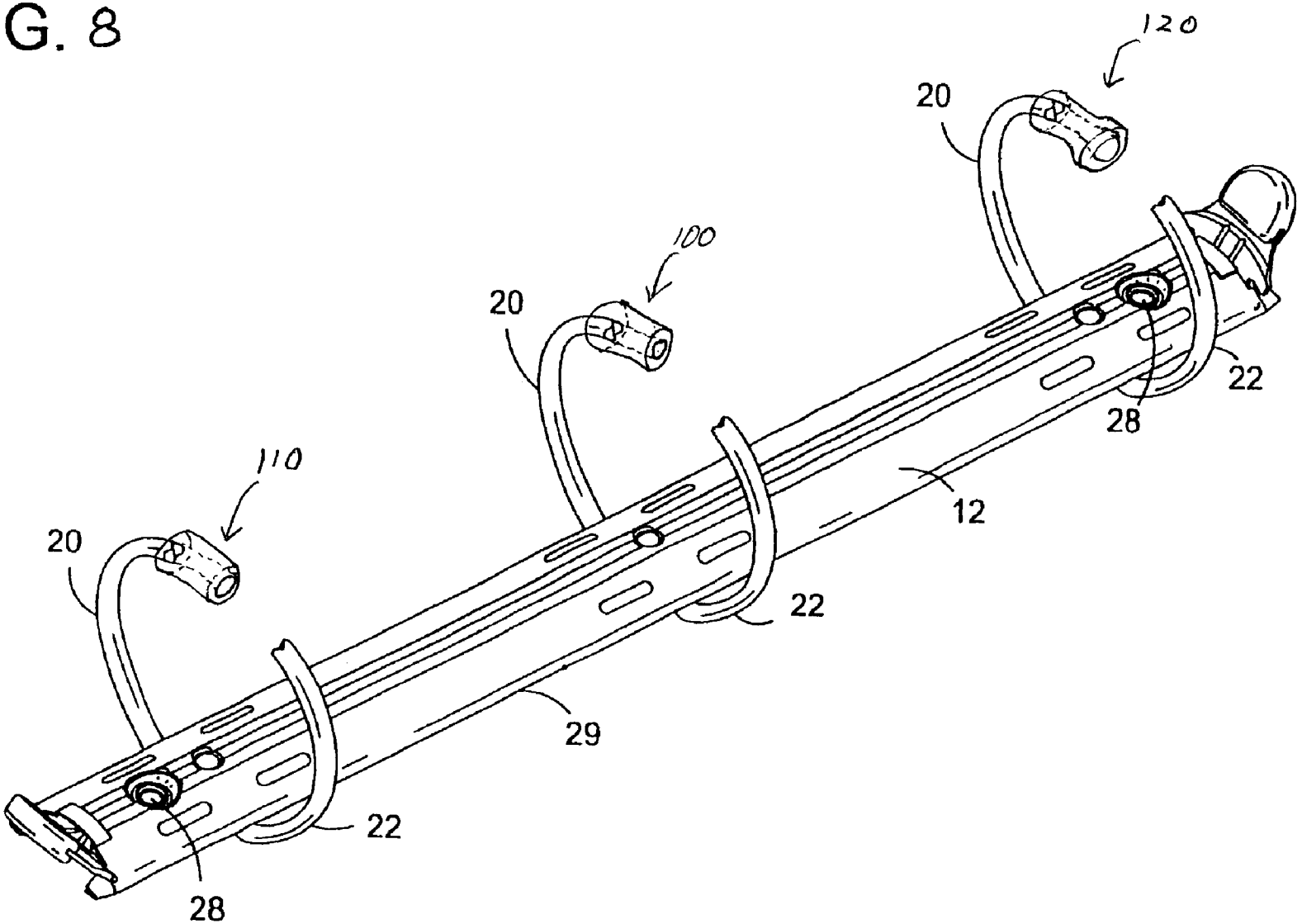
FIG. 8 is a perspective view showing an open ring binder and a tubular member disposed about the distal end of one of each pair of rings.
Figure 9:
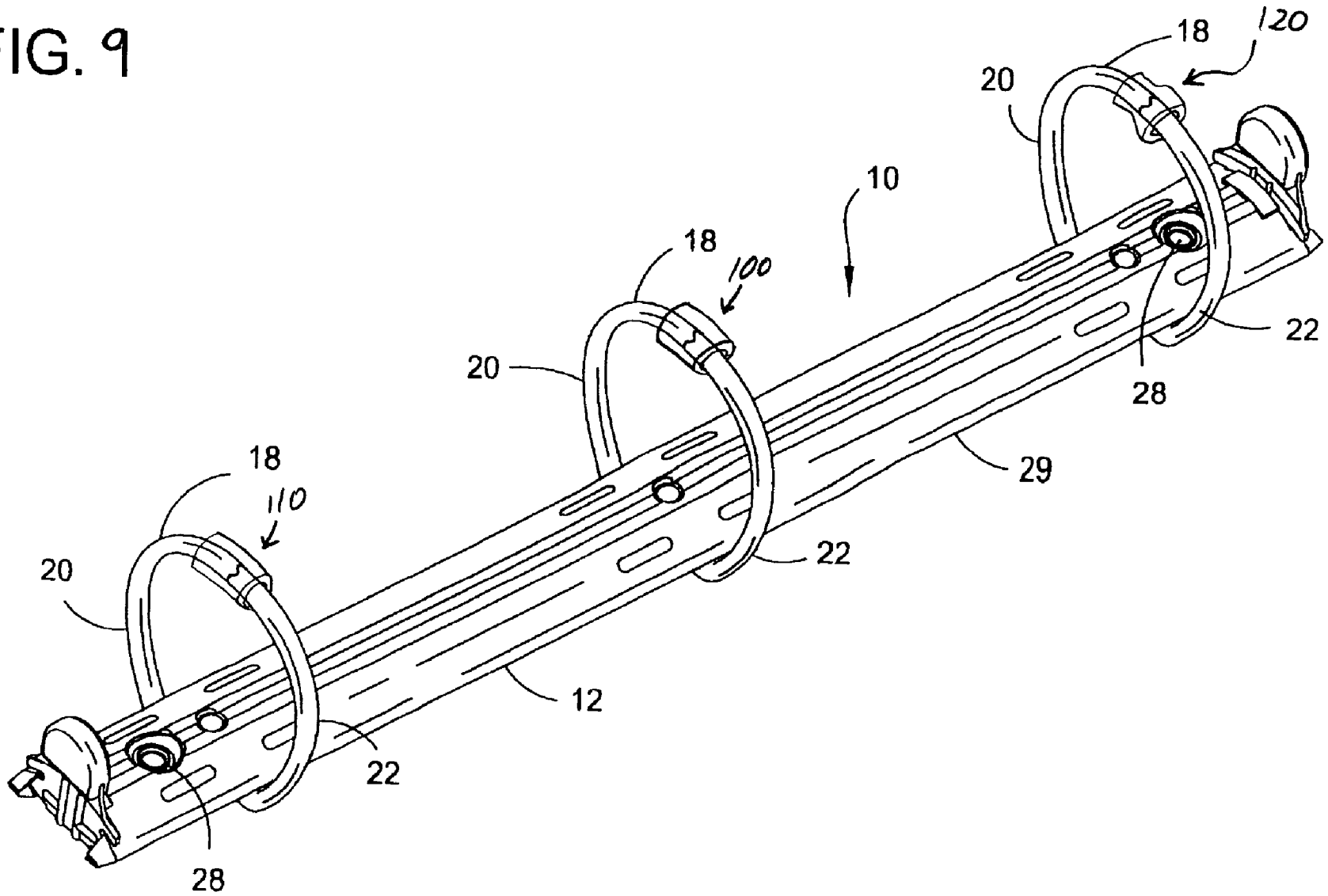
FIG. 9 is a view similar to FIG. 8 with the rings in the closed position, wherein the tubular member associated with each pair of rings is disposed about the distal ends of each ring.
Figure 11:
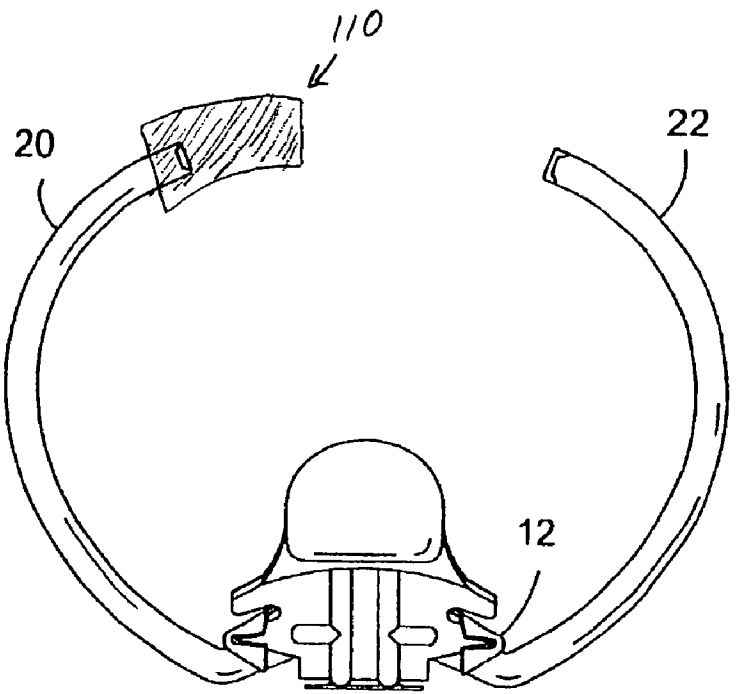
FIG. 11 is an end view of FIG. 8.
Figure 10:
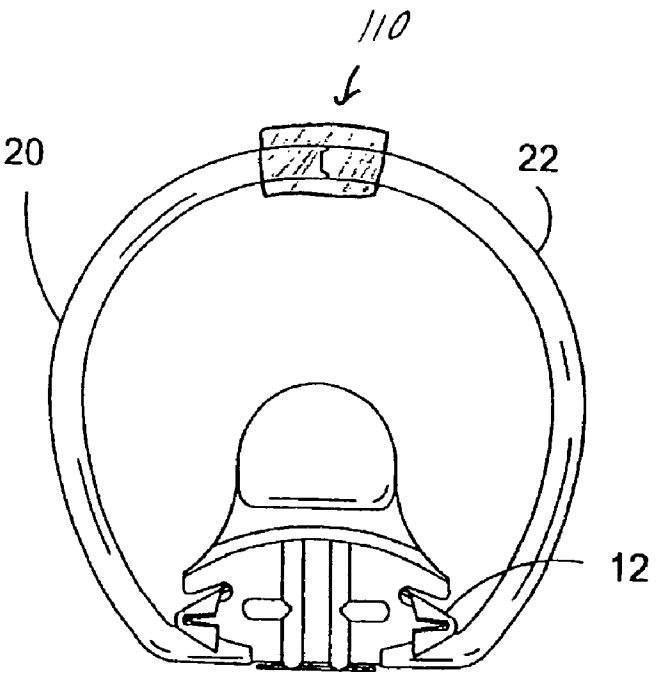
FIG. 10 is an end view of FIG. 9.
Figure 13:
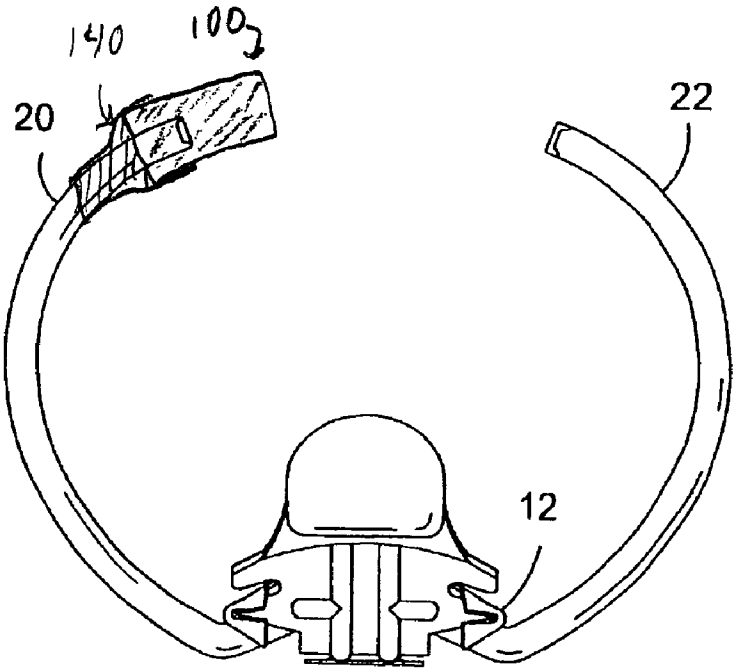
FIG. 13 is an end view of an alternate embodiment of the present invention with the rings in the closed position.
Figure 12:
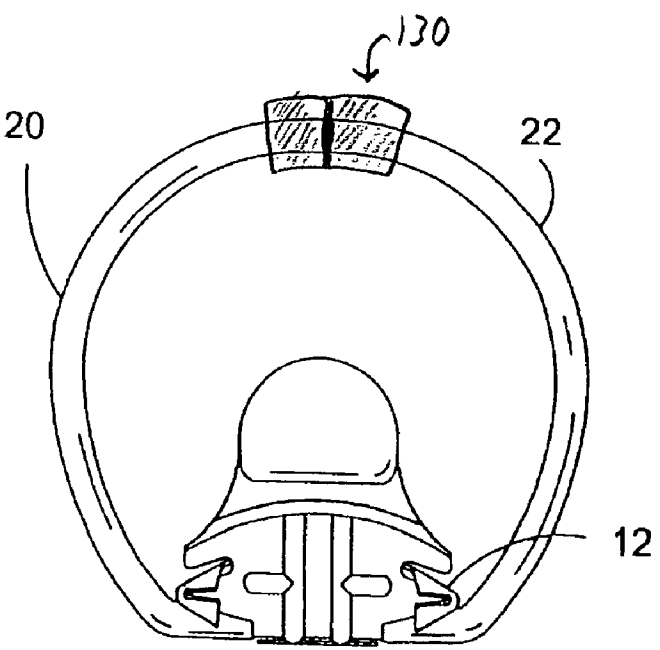
FIG. 12 is an end view of an alternate embodiment of the present invention.

Turning to the present invention, FIG. 7A shows tubular member 100 that can be placed on the distal end of one of the half-ring members when the two-half rings are in the open position (see, e.g. FIGS. 8 and 11). When the half-rings are moved from the open to closed position, the complementary half-ring member will enter the second end of the tube, thereby facilitating alignment of the half rings (see, e.g. FIGS. 9 and 10).

Tubular member 100 is generally straight and has an inner diameter "i.d." and an outer diameter "o.d." that are generally constant. Preferred inner diameters can range from about two (2) to about eight (8) millimeters while preferred outer diameters can range from about three (3) to about twelve (12) millimeters, wherein the difference (i.e. tube wall thickness) is about one (1) millimeter to about three (3) millimeters. A typical hole punch creates a paper hole of about seven (7) millimeters in diameter. Therefore a tubular member having an o.d. of less than about seven (7) millimeters is particularly preferred. Tubular member preferred length can range from about fifteen (15) to about thirty (30) millimeters Alternatively, the tubular member can be made with a bend (member 110 in FIG. 7B) or have a variable i.d. and/or o.d. (member 120 in FIG. 7C). Having a bend can facilitate the angle of entry of the half-ring upon closure. Having a larger i.d. can also facilitate closure by providing a larger target for the half-ring to which the tubular member is not secured. Also, the tubular member can have a web or other structure 132 disposed between the two ends thereof to facilitate placement of the member onto the half-rings (member 130 in FIG. 7D).

With reference to FIGS. 8-13, in operation, the user can place one of the tubular members on one or more of the half rings while the rings are in the open position. This is accomplished by sliding one end of the tubular member onto the distal (free) end of one of the half-rings. Upon closure of the half-rings, the complementary half-ring will enter the other end of the tubular member resulting in a tubular member half-ring system that reduces the likelihood that the ends of the half-rings will become misaligned. Preferably, each pair of half-rings receives a tubular member.

Further improvements in accordance with the present invention can include the use of other materials to facilitate the securement of the tubular member to one of the half rings. This can include one or more of the following: shrink tubing (see, e.g. shrink tube 140 in FIG. 12, wherein tube 140 has been heated to at least partially cover ring 20 and a portion of tubular member 100); the use of glue or other adhesive (not shown); and providing a half-ring that has a knurled surface to hold the tubing with a greater friction force as compared to a non-knurled surface (not shown). The goal of these alternate embodiments is to maintain the tubular member on one of the half-rings during opening and closing while allowing the other half-ring to engage and disengage from the tubular member upon closing and opening, respectively. Another advantage of the shrink tubing embodiment is that it provides for a smooth transition from the half-ring to the o.d. of the tubular member, which can facilitate movement of pages over the tubular member. Shrink tubing is commercially available, such as polyolefin tubing.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements. Also, while the term "half-ring members" has been used, the present disclosure includes ring members that are not necessarily "halves" of a complete ring or other structure used to secure paper.

As various changes could be made in the above constructions without departing from the scope of the invention, it is intended that all matter contained in the above description or shown in the accompanying drawings shall be interpreted as illustrative and not in a limiting sense.

What is claimed is:

1. A ring binder mechanism adapted to be secured to a base member, comprising:

a substantially rigid plate member;

a plurality of pairs of respective half-ring members, each half-ring member having first and second ends, each half-ring member first end being pivotally supported by the substantially rigid plate member and each half-ring member second end being pivotably movable between a first position wherein the pairs of half-ring members are closed and the second ends of the half-ring members are generally together, and a second position wherein the pairs of half-ring members are open and the second ends of the half-ring members are spaced apart; and at least one tubular member having first and second ends, the first end being disposed over a portion of the second end of one of the half-ring members when the half-ring members are in the second, open position and wherein when the half-ring members are in the first, closed position, the second ends of the half-ring member pair are at least partially disposed with the at least one tubular member.

2. A ring binder mechanism as claimed in claim 1, wherein at least one of the half-ring members of each pair is substantially J-shaped.

3. A ring binder mechanism as claimed in claim 1, wherein at least one of the half-ring members of each pair is substantially arcuate shaped.

4. A ring binder mechanism as claimed in claim 1, wherein at least one of the half-ring members of each pair is substantially J-shaped and the other is substantially arcuate.

5. A ring binder mechanism as claimed in claim 1, wherein both of the half-ring members of each pair are substantially arcuate shaped.

6. A ring binder mechanism as claimed in claim 1, where the at least one tubular member is generally straight.

7. A ring binder mechanism as claimed in claim 1, where the at least one tubular member is generally arcuate in configuration.

8. A ring binder mechanism as claimed in claim 1, where the at least one tubular member first end has a first inner diameter and the second end has a second inner diameter greater than the first inner diameter.

9. A ring binder mechanism as claimed in claim 1, where the at least one tubular member has a web portion disposed between the first and second ends.

10. A ring binder mechanism as claimed in claim 1, further comprising a heat shrunk tube disposed over a portion of both the ring member and the at least one tubular member.

11. A method of decreasing the likelihood that paper will become dislodged from a ring binder mechanism comprising:

providing a ring binder mechanism having a substantially rigid plate member and at least one pair of half-ring members, each half-ring member having first and second ends, wherein the first ends are pivotally supported by the substantially rigid plate member and the second ends are pivotably movable between a first position wherein the at least one half-ring pair is closed and the second ends of the at least one half-ring pair are generally together, and a second position wherein the at least one half-ring pair is open and the second ends of the at least one half-ring pair are spaced apart;

providing a tubular member having first and second ends, the first end being disposed over a portion of the second end of one of the half-ring pairs when the half-ring pair is in the second, open position; and closing the half ring pair to the first, closed position such that the second end of the other half-ring pair is disposed within the second end of the tubular member.

* * * * *